United States Patent [19]

Shiraishi et al.

[11] Patent Number: 4,572,931

[45] Date of Patent: Feb. 25, 1986

[54] ROTARY SWITCH

[75] Inventors: Tomio Shiraishi; Shinobu Ikenoue, both of Miyagi, Japan

[73] Assignee: Alps Electric Co., Ltd., Japan

[21] Appl. No.: 534,062

[22] Filed: Sep. 20, 1983

[30] Foreign Application Priority Data

Sep. 21, 1982 [JP] Japan ..... 57-141882[U]

[51] Int. Cl.[4] ..... H01H 19/54; H01H 21/76

[52] U.S. Cl. ..... 200/11 DA; 200/11 A; 200/11 G

[58] Field of Search ..... 200/11 A, 11 D, 11 DA, 200/11 G, 11 J, 11 TW, 14, 11 H

[56] References Cited

U.S. PATENT DOCUMENTS

| | | | |
|---|---|---|---|
| 2,694,756 | 11/1954 | Warnke | 200/11 A |
| 3,030,460 | 4/1962 | Huetten et al. | 200/11 G |
| 3,213,212 | 10/1965 | Sefton | 200/11 A X |
| 3,215,790 | 11/1965 | Young | 200/11 D |
| 3,226,991 | 1/1966 | Hartsock | 200/11 DA X |
| 3,258,547 | 6/1966 | Rector | 200/11 A |
| 3,352,979 | 11/1967 | Grayson et al. | 200/11 A |
| 3,588,392 | 6/1971 | Cartwright | 200/11 A |
| 3,594,527 | 7/1971 | Brant et al. | 200/11 G X |
| 3,668,338 | 6/1972 | O'Malley | 200/11 A |
| 3,689,714 | 9/1972 | Walz | 200/11 A |
| 3,736,390 | 5/1973 | Lockard | 200/11 G X |
| 4,493,954 | 1/1985 | Kimmel et al. | 200/11 G X |

OTHER PUBLICATIONS

IBM Technical Disclosure Bulletin, vol. 18, No. 10, Issued Mar., 1976 (Armonk, N.Y.), W. M. Davis, "Wafer Switch", see pp. 3405 and 3406.

*Primary Examiner*—J. R. Scott

*Attorney, Agent, or Firm*—Guy W. Shoup

[57] ABSTRACT

A rotary switch having a plurality of outputs energized according to a prearranged pattern during rotation of a shaft of the switch includes first and second switch boards spaced apart and having respective contact portions formed on the facing surfaces thereof. The contact portions of the first board include an arcuate collector and a plurality of fixed contacts arranged in a predetermined pattern, and the second board includes a plurality of fixed contacts arranged in a predetermined pattern. A slider is held rotatively between the switch boards and has two pairs of electrically-connected conductive arms with a respective pair of conductive arms extending towards the contact portions of each board. In this way, each of the fixed contacts can be connected electrically with the arcuate collector in a predetermined pattern as the slider is rotated.

2 Claims, 7 Drawing Figures

Fig. 1
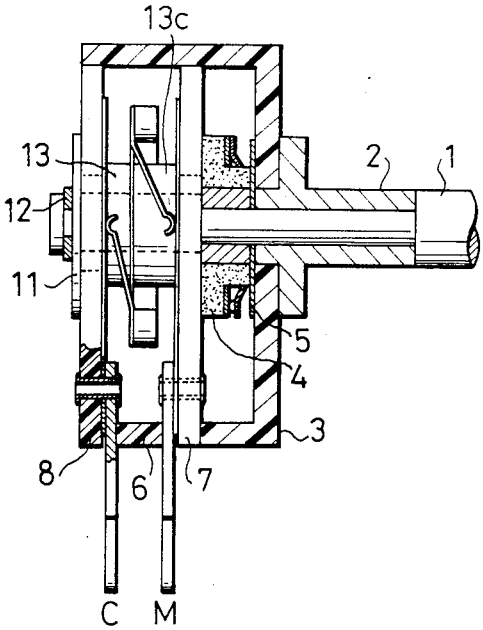
Fig. 2
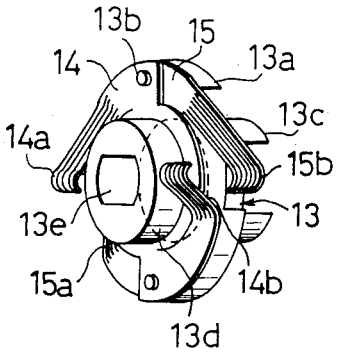
Fig. 4
| terminal M & connected terminal \ contact positon | 1 | 2 | 3 | 4 | 5 | 6 | 7 | 8 | 9 |
|---|---|---|---|---|---|---|---|---|---|
| A | ○ | | | ○ | | | ○ | | |
| B | | ○ | | | ○ | | | ○ | |
| C | | | ○ | | | ○ | | | ○ |

ROTARY SWITCH

FIELD OF THE INVENTION

This invention relates to a rotary switch and, more specifically to a rotary switch which can selectively energize a plurality of output contacts according to a prearranged pattern.

BACKGROUND OF THE INVENTION

Rotary switches are presently known wherein a plurality of output contacts can be energized in a prearranged pattern by ganging together a plurality of individual switches. Such ganged combinations of switches are, however, relatively complex and complicated to assemble.

SUMMARY OF THE INVENTION

According to the present invention, a rotary switch having a plurality of outputs energized selectively according to a prearranged pattern has two switch boards having respective circuit patterns printed thereon and a common slider therebetween. The circuit patterns of one board include a common collector continually engaged by a conductive arm of the slider, and several output contacts spaced so as to be serially engaged by another conductive arm of the slider as the slider is rotated. The circuit patterns of the other board include a plurality of output contacts engaged by other conductive arms of the slider and arranged so that the output contacts of both boards are selectively engaged by a conductive arm of the slider in a predetermined pattern during rotation of the slider.

BRIEF DESCRIPTION OF THE DRAWINGS

FIG. 1 is a side sectional view of a switch according to the present invention;

FIG. 2 is a perspective view of a slider support and sliders thereof;

FIG. 4 tabulates the switching operation.

DETAILED DESCRIPTION OF THE INVENTION

Figure 3A:
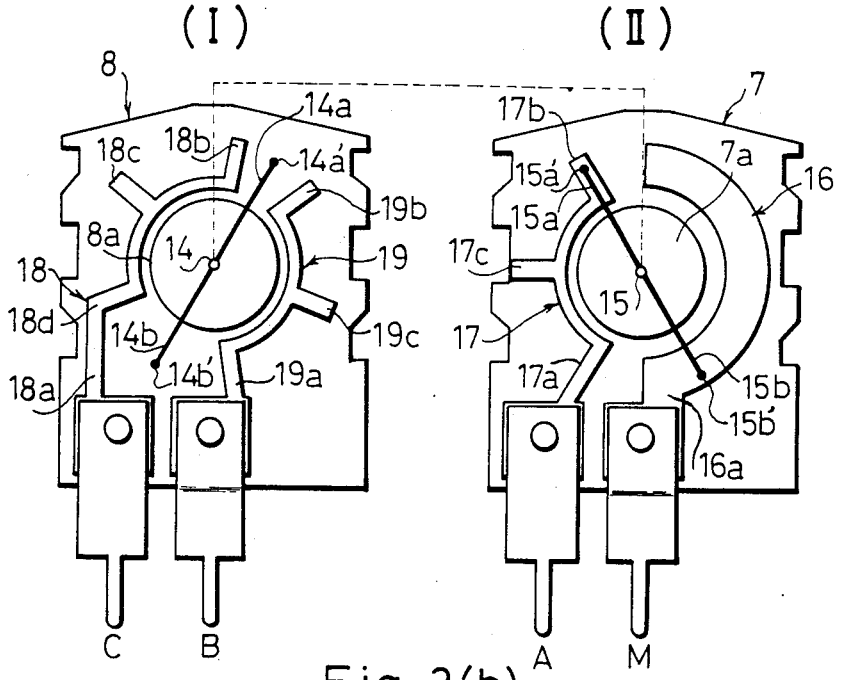
FIGS. 3(*a*), 3(*b*), 3(*c*), and 3(*d*) are plan views of the first and second switch boards of the present invention for illustrating the switching patterns.

The present invention is explained in detail with reference to the drawings. FIG. 1 is a side sectional view of a switch according to an illustrated embodiment of the present invention and illustrates a shaft 1 rotatably supported by a bearing 2 fitted within an opening of a case 3 formed of insulating material. A plate 4 is formed with a plurality of grooves engaged by a depending portion of a plate spring 5. In this way, a detent operation can be provided for rotation of the shaft 1. A case 6 formed of an insulating material houses respective switch mechanisms 7 and 8 formed by first and second switch boards fixed respectively at the opposing ends of case 6. A closing panel 11 is held to the shaft 1 by a stop ring 12, and a slider support 13 is supported rotatably between the two boards. Two conductive sliders 14 and 15 are connected electrically together by being fitted over staked portions 13*b* of the slider support.

Figure 3B:
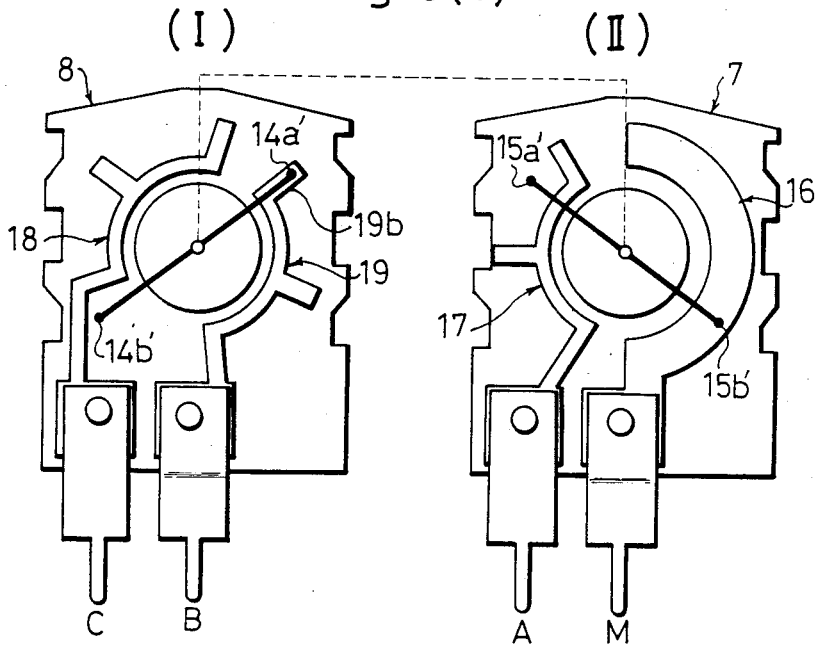
Figure 3C:
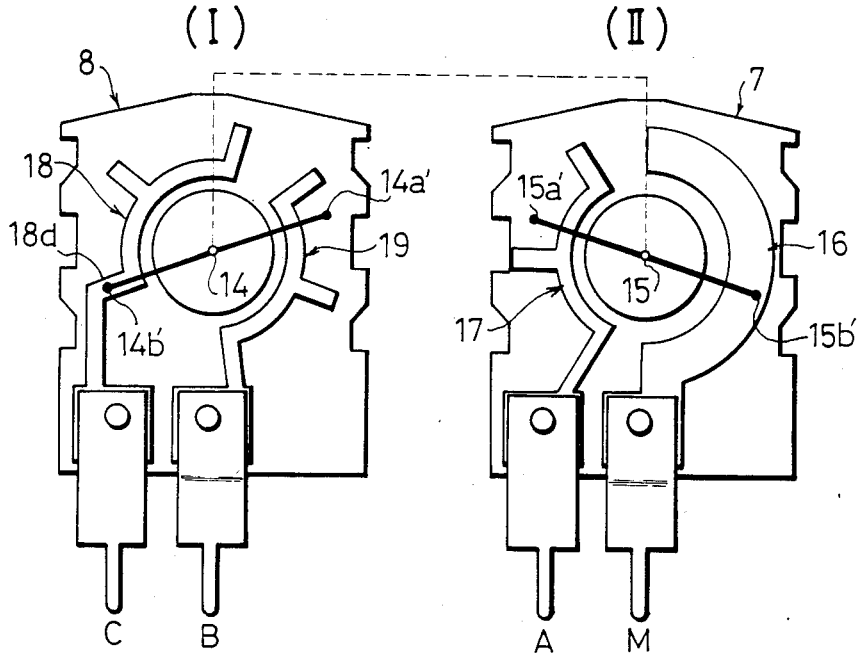
Figure 3D:
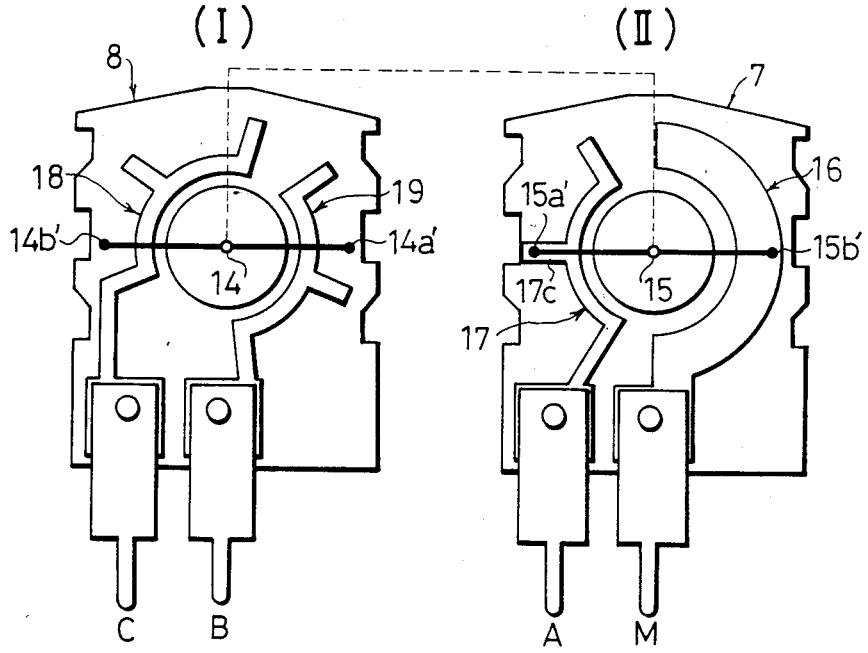

On the first switch board 7, as shown in II of FIG. 3(*a*) a semi-circular common contact 16 serving as a collector and a fixed contact 17 having spaced contact points 17*b* and 17*c* are formed by printing a silver paste or the like around opposite sides of the shaft hole 7*a*.

The common contact 16 and fixed contact are respectively connected to the common terminal M and terminal A through respective leads 16*a* and 17*a*.

On the second switch board, as shown in I of FIG. 3(*a*) a fixed contact 18 having the contact points 18*b*, 18*c* and 18*d* and a fixed contact 19 having the contact points 19*b* and 19*c* are also printed around opposing sides of the shaft hole 8*a*, and are respectively connected to the terminal C and terminal B through the leads 18*a* and 19*a*.

The sliders 14, 15 corresponding to these contacts 16, 17, 18 19 will be explained by referring to FIG. 2 and FIG. 3(*a*). The slider support has spacers 13*c* and 13*d* extending axially from the upper and lower sides of central flange 13*a*. The spacer 13*c* is coupled to the detent plate 4 for rotation therewith, and an elongated hole 3*e* of the spacers 13*c* and 13*d* receives a mating portion of the shaft. The slider support 13, therefore, rotates with the shaft 1.

The two sliders 14 and 15 are each formed from a resilient metal plate and fitted to a single surface of the flange 13*a* of slider 13. The slider 14 has a pair of contactors 14*a* and 14*b* turned upwards and the other slider 15 has a pair of contactors 15*a* and 15*b* turned downwards. Moreover, as shown in I and II of FIG. 3(*a*), contact 14*a*′ of contactor 14*a* and contact 14*b*′ of contactor 14*b* are arranged diametrically opposite one another, and in the same way the contact 15*a*′ of contactor 15*a* and contact 15*b*′ of contactor 15*b* are arranged diametrically opposite one another.

As shown in I of FIG. 3(*a*), the contacts 14*a*′, 14*b*′ of slider 14 perform switching operation in combination with the contact points 18*b*, 18*c*, 18*d*, 19*b*, 19*c* of the fixed contacts 18, 19 of the second switch board 8.

Similarly, the contacts 15*a*′, 15*b*′ of slider 15 also perform switching operation in combination with the common contact 16 and the contact points 17*b*, 17*c* of fixed contact 17 of the first switch board 7.

In I and II of FIG. 3(*a*), the dotted lines respectively indicate the sliders 14 and 15 are connected electrically together.

The operation of the illustrated rotary switch is explained by referring to FIGS. 3(*a*), 3(*b*), 3(*c*) and 3(*d*).

The condition of I and II of FIG. 3(*a*) is considered the first contact position. At this time, in I of FIG. 3(*a*), both contact 14*a*′ of contactor 14*a* and contact 14*b*′ of contactor 14*b* are not in contact with any contact point of the fixed contacts 18, 19. Meanwhile, in II of the same figure, the contact 15*a*′ of contactor 15*a* is in contact with the contact point 17*b* of the fixed contact 17 and the contact 15*b*′ of contactor 15*b* is also in contact with the common contact 16. Therefore, the terminal A and common terminal M are connected electrically together.

When the shaft 1 is rotated clockwise (to the second contact position) for one step in the second switch board 8 (opposite direction on the first switch board) from the above condition, the contact 14*a*′ of contactor 14*a*, in I of FIG. 3(*b*), is in contact with the contact point 19*b* of the fixed contact 19, while the contact 14*b*′ of contactor 14*b* is not in contact with any contact point of the fixed contact 18. Meanwhile, in II of FIG. 3(*b*), the contact point 15*a*′ of contactor 15*a* is not in contact with any contact point of the fixed contact 17 and the contact point 15*b*′ of contactor 15*b* is in contact with the common contact 16. Accordingly, the terminal B and common terminal M are connected electrically together.

When the shaft 1 is further rotated clockwise (to the third contact position) for one step from such condition, in I of FIG. 3(*c*), the contact 14*a*′ of contactor 14*a* is not in contact with any contact point of fixed contact 19 but the contact 14*b*′ of contactor 14*b* is in contact with the contact point 18*d* of fixed contact 18, while in II of FIG. 3(*c*), the contact 15*a*′ of contactor 15 is not in contact with any contact point of fixed contact 17 and the contact 15*b*′ of contactor 15*b* is in contact with the common contact 16. Therefore, the terminal C and common terminal M are connected electrically together.

When the shaft 1 is further rotated clockwise (to the fourth contact position) for one step from the condition of FIG. 3(*c*), in I of FIG. 3(*d*), the contact 14*a*′ of contactor 14*a* and contact 14*b*′ of contactor 14*b* are not in contact with any contact point of the fixed contacts 19, 18, while as shown in II of the same figure, the contact 15*b*′ of contactor 15*b* is in contact with the common contact 16 and the contact 15*a*′ of contactor 15*a* is in contact with the contact 17*c* of fixed contact 17. Accordingly, the terminal A and common terminal M are connected electrically together.

In the same way, when the shaft is rotated to the fifth and sixth positions, the terminals B, C and common terminal M are connected respectively.

When the shaft 1 is further rotated in the same direction to the seventh, eighth and ninth positions, the terminals A, B, C are sequentially connected to the common terminal M in the exactly same manner as explained above. Such switching operation is tabulated in FIG. 4. The rotation of the shaft 1 may be restricted to an angular range, or may be set endlessly. At any rate, it can be selected easily in accordance with design needs.

What is claimed is:

1. A rotary switch comprising:

a first switch board having a semicircular common contact and a fixed contact having a plurality of contact points, a second switch board having two fixed contacts having a plurality of fixed contact points, a slider support means including two sliders connected electrically together and each slider having at least one pair of contactors so that one of said pairs of contactors formed on one of said sliders is brought into contact with said common contact and said fixed contacts formed on said first switch board while a pair of contactors formed on the other slider are brought into contact with said fixed contact formed on said second switch board.

2. A rotary switch having a plurality of outputs energized according to a prearranged pattern during rotation of a shaft of said switch, said switch including first and second switch boards spaced apart and having respective contact portions formed on the facing surfaces thereof, the contact portions of said first board including an arcuate collector and a plurality of fixed contacts arranged in a predetermined pattern and said second board including a plurality of fixed contacts arranged in a predetermined pattern, and means including a slider held rotatably between said switch boards and having two pairs of electrically-connected conductive arms with a respective pair of conductive arms extending towards the contact portions of each said board for connecting each of said fixed contacts electrically with said arcuate collector in a predetermined pattern as said slider is rotated.

* * * * *